United States Patent [19]

Faber et al.

[11] 4,329,203

[45] May 11, 1982

[54] MULTIPLE STAGE COMBUSTION MEANS FOR HEATING SLOT TYPE COKE OVENS

[75] Inventors: Paul V. Faber; Howard H. Shih, both of Morristown, N.J.

[73] Assignee: Wilputte Corporation, Murray Hill, N.J.

[21] Appl. No.: 182,791

[22] Filed: Aug. 29, 1980

[51] Int. Cl.[3] ..... C10B 5/02; C10B 21/06; C10B 21/12; C10B 21/22

[52] U.S. Cl. ..... 202/135; 202/142; 202/151

[58] Field of Search ..... 202/135, 139, 142, 151, 202/220

[56] References Cited

U.S. PATENT DOCUMENTS

| | | | |
|---|---|---|---|
| 1,455,527 | 5/1923 | Goffart . | |
| 1,475,881 | 11/1923 | Roberts . | |
| 1,478,570 | 12/1923 | Kus . | |
| 1,596,408 | 8/1926 | Ditto . | |
| 3,170,851 | 2/1965 | Van Ackeren . | |
| 3,183,175 | 5/1965 | Breitbach et al. . | |
| 3,211,632 | 10/1965 | Otto | 202/142 |
| 3,261,763 | 7/1966 | Tucker, Jr. . | |
| 3,304,240 | 2/1967 | Van Ackeren . | |
| 3,373,087 | 3/1968 | Van Ackeren . | |
| 3,385,767 | 5/1968 | Van Ackeren . | |
| 3,433,714 | 3/1969 | Van Ackeren . | |
| 3,488,259 | 1/1970 | Grumm . | |
| 3,689,365 | 9/1972 | Steding et al. . | |
| 3,730,847 | 5/1973 | Pries et al. . | |
| 3,801,470 | 4/1974 | Knappstein et al. | 202/142 |
| 3,953,299 | 4/1976 | Strepelis et al. . | |
| 3,996,109 | 12/1976 | Pries . | |
| 4,249,997 | 2/1981 | Schmitz | 202/142 |

*Primary Examiner*—Bradley Garris

*Attorney, Agent, or Firm*—Buell, Blenko, Ziesenheim & Beck

[57] ABSTRACT

A heating system for tall horizontal slot type coke ovens wherein the heating walls are provided with flues in which combustion occurs at multiple levels. The improvement lies in having a single flue stack of two channel design, each channel having port openings located at corresponding different heights or levels above the flue floor. When lead gas is employed for fuel, lean gas and air are supplied from different regenerator chambers to the separate channels respectively whereby a mixture of fuel gas and air is effected and combustion occurs at the port exit openings at each successive level. When rich gas is employed as a fuel, both regenerator chambers are employed to supply air for combustion through both channels of the stack and rich fuel gas is supplied by a separate distribution system to each vertical flame flue. Regulation of the flow of rich gas or lean gas from the two channels is provided by an adjustable brick means, such as a slide brick at the top of the two channels.

3 Claims, 4 Drawing Figures

MULTIPLE STAGE COMBUSTION MEANS FOR HEATING SLOT TYPE COKE OVENS

This invention relates to heating systems for tall horizontal slot type coke ovens, particularly to heating systems in which gas burns at a multiple number of vertical levels in each heating flue to provide uniform heat on the total height of the oven heating wall.

We provide a construction in coke oven heating systems whereby a solid partition wall divides a flue stack into two vertical channels extending from the top of the regenerator pillar wall upwards to the top of the stack. One channel connects through the duct in the corbel brickwork with an opening into a regenerator chamber on one side and the other channel of the two connects through the duct in the corbel brickwork with an opening to the adjacent regenerator chamber. One channel only is supplied with air and the other with lean gas. With this system, the incoming currents of air and gas mix and combustion occurs at the exit openings at each successive level. When rich gas is employed for heating, air is supplied through both channels and the gas is admitted through a separate duct opening into the bottom of the flue.

Our invention is described in further detail hereinafter in connection with the accompanying drawings, wherein.

Figure 1:
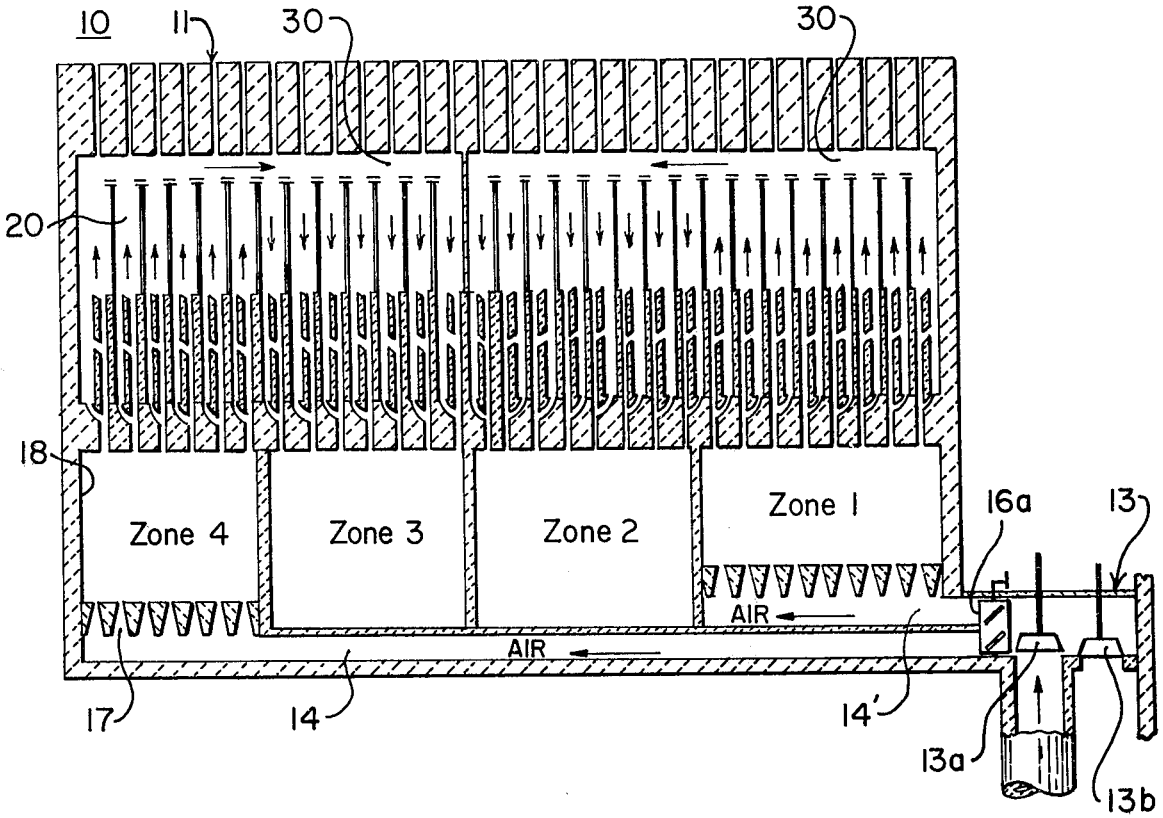
FIG. 1 is a diagrammatic longitudinal sectional view through a coke oven flue structure, showing an oven heating system with zone control combustion air flow.
Figure 4:
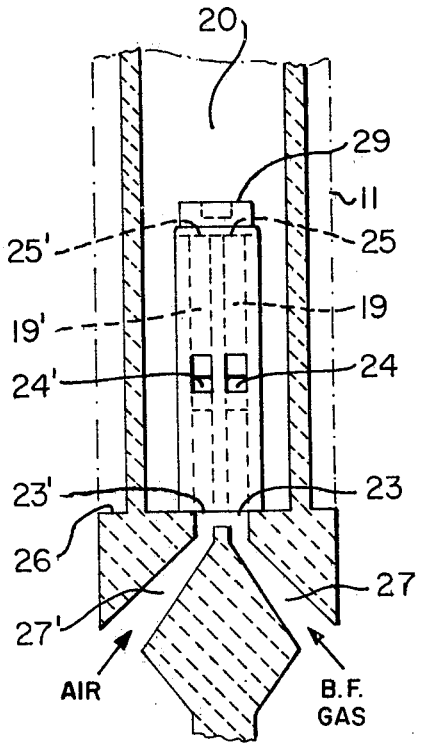
Figure 3:
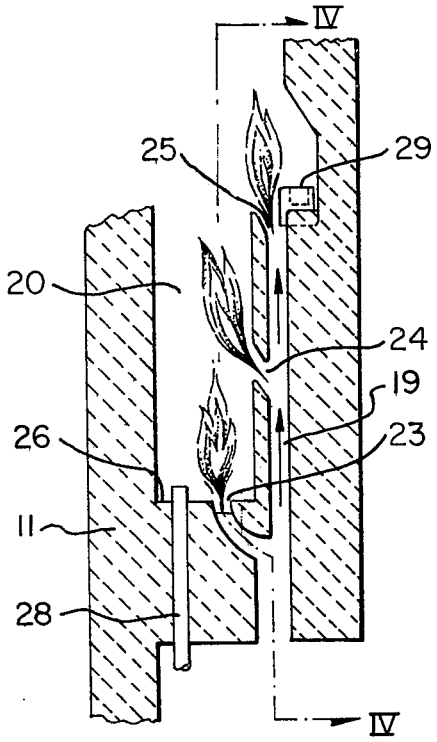

FIG. 3 is an enlarged fragmentary view of a section of the heating wall in FIG. 1 showing our improved two channel construction for mixing air and lean fuel gas to effect combustion of the lean fuel gas at the exits from the channels into the flue; and FIG. 4 is a sectional view, taken on the line IV—IV of FIG. 3, showing another view of the two channel construction for admission of air and lean fuel gas into each heating wall flue.

Figure 2:
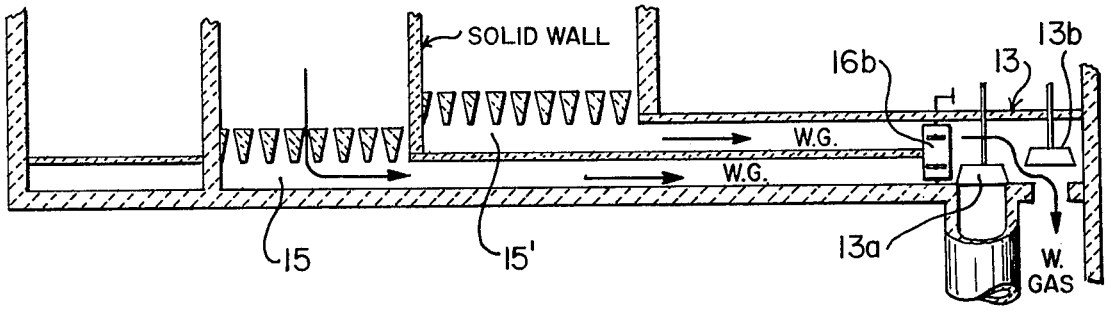
FIG. 2 is a diagrammatic longitudinal sectional view complementary to FIG. 1, showing the flow of waste gas from the zones of flues.

Referring to FIGS. 1 and 2 of the drawings, there is shown the essential parts of the heating system of a coke oven 10 having a heating wall 11 embodying zone control of flow of air or air and lean gas to the flues of the heating wall. The flues are divided by solid brick walls into respective groups called zones, identified as #1, #2, #3 and #4, whereby air or air and lean gas may be admitted to and released from a plurality of zones under common control of a reversing valve 13 at either the coke side or the pusher side of the coke oven. As seen in FIG. 1, a reversing valve 13*a* is shown in open position supplying air (or lean gas) to sub flue ducts 14, 14', past air registers or dampers 16*a* whence the air flows via venturi ports 17 into and through the brickwork of regenerator chambers 18 of zones 1 and 4 to the twin channels 19, 19' (FIG. 4) in flues 20. The waste gas leaving flues 20 of zones 1 and 4 collects in a horizontal flue 30 and then flows toward the center of the battery before redistributing to the flues 20 of zones 2 and 3 whence the waste gas flows into the sub ducts 15, 15' (FIG. 2) via venturi ports. As seen in FIG. 2, the waste gas dampers 16*b* and reversing valve 13*b* are in position for releasing the waste gas (W.G.) from zones 2 and 3 of flues.

During a burning cycle as shown in FIGS. 1 and 2, the regenerator shown admits air to zones 1 and 4 and exhausts waste gas (W.G.) from zones 2 and 3, while at the same time from the adjacent regenerator lean fuel gas is admitted to zones 1 and 4 and waste gas is exhausted from zones 2 and 3.

As shown in FIG. 4, the channels 19 and 19' each have ports 23, 23', 24, 24' and 25, 25' opening respectively into the flue 20 at corresponding heights or levels above the coke oven floor 26. The respective channels have separate ducts 27, 27' through which lean fuel gas and air are supplied simultaneously from separate regenerator chambers in a manner not shown herein.

It will be understood that the mixture of incoming air and lean fuel gas occurs the instant the air and gas leaves the ports 23, 23', 24, 24', 25 and 25' on entering the flue 20. Thus, combustion of the fuel gas occurs at the different levels of the ports, thereby effecting a distribution of heating vertically of the wall.

As shown in FIG. 3 and FIG. 4, an adjusting brick means such as a slide brick 29, is provided at the top of each set of channels 19, 19'. By adjusting the position of the slide brick, the free flow are from twin channels 19, 19' through port openings 25, 25' may be regulated. This adjustment would allow uniform vertical heating for either rich gas heating or lean gas heating.

A separate inlet pipe is provided for supplying a rich fuel gas, such as coke oven gas (c.o.g.) into the flue. In this case air is supplied through both of the ducts 27, 27' leading to channels 19 and 19'; and combustion of the rich fuel gas occurs throughout the flue 20 and not at one level only.

The advantages or our design of two channels in the heating flues will be readily apparent, for the same design of channels lends itself to use whether the gases employed for fuel are lean gases such as blast furnace gas, or rich gases, such as coke oven gases.

While we have shown a specific detailed structure for the coke oven heating system embodying our invention, it will be understood that modifications therein are possible within the terms of the appended claims.

What we claim is:

1. A heating system for tall horizontal type coke ovens having heating walls adjacent coke oven chambers within which walls are vertical flues for effecting combustion of fuel gases admitted thereto, wherein the improvement comprises two side-by-side vertical channels in a wall of each flue through which air and lean fuel gas are separately admitted into that flue from different sources at corresponding different levels for effecting mixture of air and fuel gas as they enter the flues and the combustion of the fuel gas at different levels in the flues above the floor of the coke oven chamber and including a source means for air connected to one channel and a source for lean gas connected to the other channel.

2. A heating system for tall horizontal type coke ovens according to claim 1 in which an adjusting brick means is located adjacent the tops of said vertical channels so as to simultaneously control the flow of air and lean gas out of the tops of the vertical channels into each flue.

3. A heating system for tall horizontal type coke ovens having heating walls adjacent coke oven chambers within which walls are vertical flues for effecting combustion of fuel gases admitted thereto, wherein the improvement comprises a first source means for air and two side-by-side vertical channels in a wall of each flue through which two channels air from said first source means is supplied simultaneously to that flue from a single heating source, and a second source means for rich fuel gas and communication means separate from said channels through which communication means a rich fuel gas from said second source means is supplied to said flues simultaneously with the air.

* * * * *

UNITED STATES PATENT AND TRADEMARK OFFICE

CERTIFICATE OF CORRECTION

PATENT NO. : 4,329,203

DATED : May 11, 1982

INVENTOR(S) : Paul V. Faber and Howard H. Shih

It is certified that error appears in the above-identified patent and that said Letters Patent are hereby corrected as shown below: On the cover sheet In the Abstract, line 7, "lead" should be --lean--.

Column 2, line 22, --28-- should be inserted after "pipe".

Signed and Sealed this

*Third* Day of *August 1982*

[SEAL]

*Attest:*

GERALD J. MOSSINGHOFF

*Attesting Officer*

*Commissioner of Patents and Trademarks*